US008955683B2

(12) United States Patent
Agababov

(10) Patent No.: US 8,955,683 B2
(45) Date of Patent: Feb. 17, 2015

(54) PACKAGING FOR PORTIONS OF CONFECTIONERY PRODUCT AND MEANS FOR SECURING THE SAME IN PACKAGING

(76) Inventor: Valery Eduardovich Agababov, Moscow (RU)

( * ) Notice: Subject to any disclaimer, the term of this patent is extended or adjusted under 35 U.S.C. 154(b) by 0 days.

(21) Appl. No.: 13/497,941

(22) PCT Filed: Sep. 24, 2010

(86) PCT No.: PCT/RU2010/000530
§ 371 (c)(1),
(2), (4) Date: Sep. 7, 2012

(87) PCT Pub. No.: WO2011/037496
PCT Pub. Date: Mar. 31, 2011

(65) Prior Publication Data

US 2012/0325717 A1 Dec. 27, 2012

(30) Foreign Application Priority Data

Sep. 25, 2009 (RU) ..... 2009135663
Jun. 25, 2010 (RU) ..... 2010125980

(51) Int. Cl.
*B65D 21/00* (2006.01)
*B65D 85/36* (2006.01)
*B65D 43/02* (2006.01)

(52) U.S. Cl.
CPC ..... *B65D 85/36* (2013.01); *B65D 43/0212* (2013.01); *B65D 2543/00138* (2013.01); *B65D 2543/00296* (2013.01); *B65D 2543/00361* (2013.01)
USPC ..... 206/514; 220/507; 220/557

(58) Field of Classification Search
USPC ..... 206/514, 557, 565; 220/575, 506, 556, 220/527, 528, 524, 507
See application file for complete search history.

(56) References Cited

U.S. PATENT DOCUMENTS 1,718,668 A * 6/1929 Smythe ..... 249/52
1,978,695 A * 10/1934 Clark ..... 211/77

(Continued)

FOREIGN PATENT DOCUMENTS

CN 2551603 Y 5/2003
CN 200985170 Y 12/2007

(Continued)

OTHER PUBLICATIONS

Abstract Chart including English Abstracts for the following references: RU2315481; RU2310329; RU54917; RU270490; RU97985; RU89846; RU2038032; RU2093032.

(Continued)

*Primary Examiner* — Fenn Mathew
*Assistant Examiner* — Christopher McKinley
(74) *Attorney, Agent, or Firm* — Berenato & White, LLC

(57) ABSTRACT

The group of inventions relates to the food industry, more specifically to embodiments of a packaging for pre-portioned confectionery goods consisting of one or a number of portions. A packaging for confectionery goods consisting of a number of portions comprises a lid and a base that is provided with at least one raised flat section for holding trays corresponding to the number of portions of the goods in question. Each tray has a means for the removal thereof from the packaging, in the form, for example, of a tongue situated on the side that faces the edge of the packaging base, and at least one tray anchoring projection with a widened part is provided on the base between each pair of adjacent trays. Furthermore, pairs of projections may be provided along the edges of the raised section to restrict the movement in a horizontal plane both of the tongues and of the trays with the confectionery goods. The trays are designed so that they can be attached to at least part of the base of the confectionery goods by means of an adhesive food substance. The technical effect of the invention is an increase in the reliability with which confectionery goods are secured inside a packaging, and an increase in the ease of handling of the confectionery goods by the user during consumption.

18 Claims, 4 Drawing Sheets

(56) References Cited

U.S. PATENT DOCUMENTS

| | | | | | |
|---|---|---|---|---|---|
| 2,085,728 | A | * | 7/1937 | Clark | 206/460 |
| 2,520,522 | A | * | 8/1950 | Adams | 426/87 |
| 2,525,337 | A | * | 10/1950 | Brooks et al. | 206/551 |
| 3,335,846 | A | * | 8/1967 | Mills | 206/551 |
| 3,477,770 | A | | 11/1969 | Niemi | |
| 3,739,935 | A | * | 6/1973 | Cairns et al. | 220/23.4 |
| 3,747,754 | A | * | 7/1973 | Nix et al. | 209/608 |
| 4,197,940 | A | * | 4/1980 | DeRossett | 220/780 |
| 4,359,159 | A | * | 11/1982 | Pollard | 206/551 |
| 4,741,452 | A | * | 5/1988 | Holzkopf | 220/783 |
| 4,886,179 | A | * | 12/1989 | Volk | 220/23.4 |
| 4,947,993 | A | * | 8/1990 | Bruml et al. | 206/551 |
| 5,098,013 | A | * | 3/1992 | France et al. | 229/115 |
| 5,101,997 | A | * | 4/1992 | Bagwell et al. | 220/23.4 |
| 5,335,804 | A | * | 8/1994 | Flory | 211/78 |
| 5,356,008 | A | * | 10/1994 | Chung | 206/449 |
| 5,366,201 | A | * | 11/1994 | Diaz | 249/119 |
| 5,397,051 | A | | 3/1995 | Liu et al. | |
| 5,446,965 | A | * | 9/1995 | Makridis | 30/303 |
| 5,518,746 | A | * | 5/1996 | Diaz | 426/282 |
| 5,544,499 | A | * | 8/1996 | Boggs | 66/1 A |
| D421,903 | S | * | 3/2000 | Craker | D9/433 |
| 6,382,452 | B1 | * | 5/2002 | Getachew et al. | 220/524 |
| 7,147,125 | B1 | * | 12/2006 | Slovak et al. | 220/592.2 |
| D626,716 | S | * | 11/2010 | Mederer | D1/106 |
| 7,926,657 | B1 | * | 4/2011 | Dougan | 206/459.5 |
| 2005/0116483 | A1 | * | 6/2005 | Lang et al. | 294/7 |

FOREIGN PATENT DOCUMENTS

| | | | |
|---|---|---|---|
| DE | 6603080 | U | 9/1969 |
| KR | 200300020736 | A | 3/2003 |
| RU | 2038032 | C1 | 6/1995 |
| RU | 2093032 | C1 | 10/1997 |
| RU | 25980 | U1 | 11/2002 |
| RU | 53656 | U1 | 5/2006 |
| RU | 54917 | U1 | 7/2006 |
| RU | 2310329 | C2 | 11/2007 |
| RU | 2314985 | C1 | 1/2008 |
| RU | 2315481 | C1 | 1/2008 |
| RU | 89846 | U1 | 9/2009 |
| RU | 97985 | U1 | 9/2010 |
| RU | 2403197 | C1 | 11/2010 |
| RU | 2419581 | C1 | 5/2011 |
| SU | 270490 | A1 | 1/1970 |

OTHER PUBLICATIONS

International Search Report for PCT/RU2010/000530; International Filing Date Sep. 24, 2010; Mail date Feb. 24, 2011, 10 pages.

* cited by examiner

PACKAGING FOR PORTIONS OF CONFECTIONERY PRODUCT AND MEANS FOR SECURING THE SAME IN PACKAGING

FIELD OF THE INVENTION

The group of inventions relates to the food industry, namely, to variants of a packaging for one or several portion confectionery goods, such as cakes, pastry slices, pies, and similar goods.

BACKGROUND OF THE INVENTION

A prior art base of a cake packaging box is provided with radial and peripheral stiffening ribs preventing deformation of the cake when the box base is curved during carriage from place to place (Patent RU 2,314,985).

The cross-sectional shape of the box base is designed to serve this purpose.

Another prior art box for uncut cake has a lid that can be attached to the base by fastening means. The shaped base comprises several raised sections formed as sectors with radial grooves provided in between and converging on the central part of the base that has a depression. Two annular projections provided on the base periphery alternate with annular grooves. The base provided inside the box with a cake tray is identical in shape to the main part of the base (U.S. Pat. No. 4,197,940).

In the inventors' view, the cross-sectional shape of the box base and tray must improve cohesion between the base and tray and between the tray and the underside of the cake.

The inventions of the two prior art patents relate to the packaging of uncut confectionery goods and, therefore, do not have means for removing separate portions of the product from the packaging.

Yet another prior art device comprises pushers for portions of a confectionery product to be removed and transferred to their respective trays, each having a wedge shape and being provided with a carrying handle (Patent CN 2,551,603).

This prior art device is not a packaging, and rather is designed for stationary use at cafeterias, stores, and the like. Moreover, as a portion of a confectionery product is removed by pushers in the prior art device, it is likely to be damaged.

A further prior art packaging, or carton assembly, is intended for holding presliced cake segments provided with flaps. Each cake slice is wrapped around on three sides thereof with a segmented packaging element. The wrapped cake slices are placed on a plate and a cover is put over them (U.S. Pat. No. 4,359,159).

The prior art packaging requires too much packaging material.

Still another prior art packaging for individual parts of a cake or pastry slices comprises a box having a container for the cake parts inside and at least one element in the form of a grip to remove an individual cake part from the container. The grip is made from a strip of firm material curved into a U-shaped item (Patent RU 53,656).

A disadvantage of the grip used in this prior art packaging is that it grips a cake part from top and bottom, with a very high likelihood that the cake part having its top surface unprotected may be damaged by a finger of the consumer's hand upon removal from the box.

The preceding two prior art inventions have a further disadvantage that the consumer cannot see how the product he buys looks on the outside.

Patent KR 20030020736 describes a method for providing adhesion between a confectionery product and tray by silastic (silicone resin) that is neutral to humans, but is not a food product itself. When actually used, the prior art invention does not fully prevent pieces of resin from sticking to the confectionery product and getting into the human organism with it.

SUMMARY OF THE INVENTION

It is an object of this invention to preserve the integrity and marketable appearance of packaged confectionery products such as cake portions, pastry slices, pies, and so on as they are delivered from the producer to sellers, and then to the end consumer.

The technical effect of the invention is improved reliability with which a confectionery product is held inside the packaging, and also improved convenience of confectionery product consumption.

This technical effect is achieved in the present invention by the combination of features described below.

A packaging for a confectionery, preferably baked, product consisting of several portions comprises a lid and a base provided with at least one raised flat section intended to support a plurality of trays according to the number of portions of the product, each tray having means for removing the same from the packaging, said means being at least one section of the tray projecting beyond the plane of the raised section of the base and located at the side facing the edge of the tray base, and at least one projection is formed between each pair of adjacent trays on the base to secure the trays in place.

The packaging base may have several raised flat sections according to the number of product portions, each raised section possibly having a teardrop-shaped shape in plan that narrows toward the base center.

According to one embodiment of the invention, one anchoring projection may be provided on the packaging base between each pair of adjacent trays, and a widened anchoring projection of, for example, dome-shaped configuration may be provided in the central part of the base.

In another embodiment of the invention, two anchoring projections may be provided on the packaging base between each pair of adjacent trays, one of said projections being located near the central part of the base having, for example, a depression of hemispherical shape.

Each anchoring projection may be teardrop-shaped in plan and have a widened part of T-shaped cross-section.

In the embodiment in which the packaging base is provided with one raised section, the height of each anchoring projection is greater than the thickness of a tray, and in the embodiment in which the packaging base has several raised sections, the height of each anchoring projection is greater than the total height of a raised section of the base and the thickness of the tray.

The means for removing a tray from the packaging made in the form of at least one tray section projecting beyond the plane of the raised section of the base may be in the shape of a tongue.

The edges of the raised section of the base may be provided with one or two pairs of anchoring projections for one or two tray tongues to be located between them to limit movement of the tray together with the piece of cake in the horizontal plane.

The packaging for a sliced, preferably baked, confectionery product consisting of a single portion comprises a lid and a base having a raised flat section to receive a tray with the portion of said product, the tray having means for removing it from the packaging in the form of at least one tray section projecting beyond the plane of the raised base section, and at least one projection is formed in the base to keep the tray in place, two such projections being provided in the preferred embodiment.

Each anchoring projection has a widened part of T- or L-shaped cross-section.

The height of each anchoring projection is greater than the thickness of the tray.

The means for removing a tray from the packaging in the form of at least one section of the tray projecting beyond the plane of the raised section of the base may be in the form of a tongue.

The edge of the raised section of the base may be provided with one or two pairs of anchoring projections for one or two tray tongues to be located between them to limit the movement of the tray together with a piece of cake in the horizontal plane.

The base and lid of the packaging in both embodiments of the utility model are made of a food polymer material by molding.

A further subject matter claimed herein is means for preventing movement of a sliced, preferably baked, pastry product within the packaging, said means comprising a tray of an area larger than the area of the underside of said product and attached to a part of said underside by adhesive food substance.

A gel based on a substance selected from the series of carrageenan, pectin, gelatin, modified starch, and dextrin, or a syrup based on mono- or disaccharides, or honey, or a molasses-based product is used as adhesive food substance.

The tray may be made of laminated cardboard or food polymer material.

BRIEF DESCRIPTION OF THE DRAWINGS

The invention is illustrated in the accompanying drawings, wherein.

DESCRIPTION OF AN EMBODIMENT OF THE INVENTION

Figure 1:
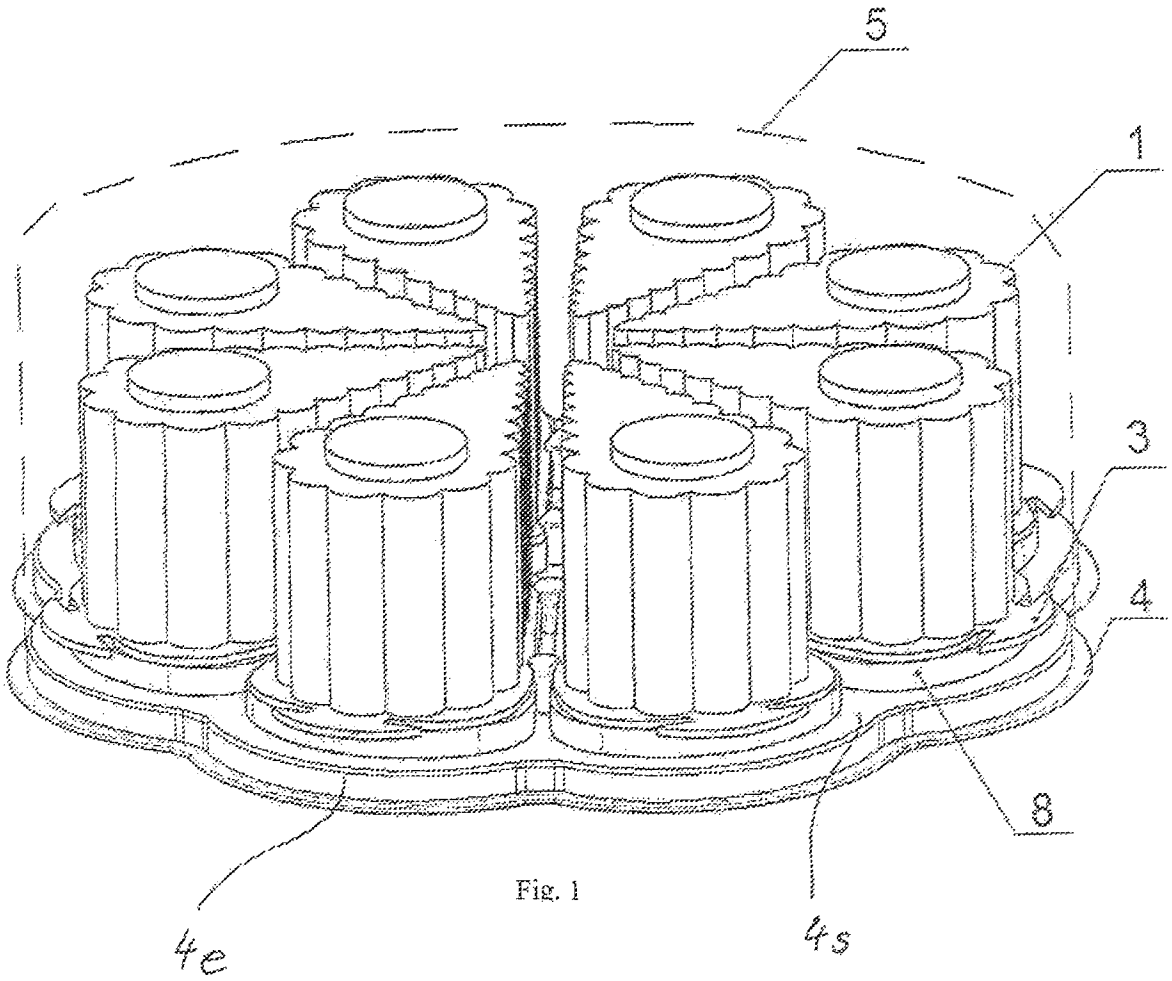
FIG. 1 is a diagrammatic view of the packaging with a confectionary product such as a sliced cake (an isometric view)
Figure 2:
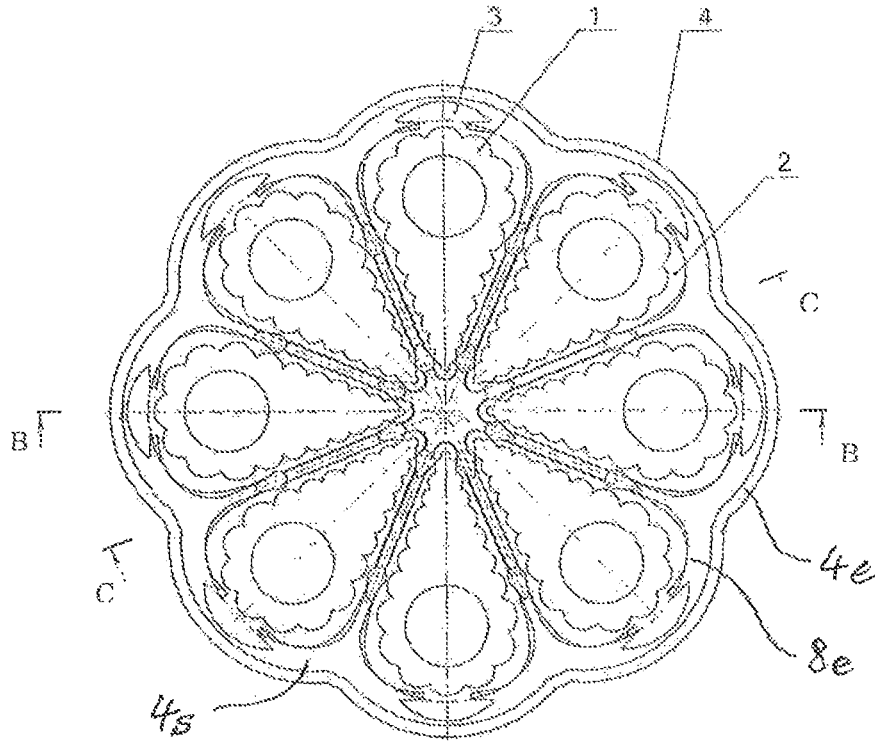
FIG. 2 is a top view of the same package.

FIG. 1 and FIG. 2 of the drawings show a packaging for a confectionery product such as a cake sliced into portions 1, each portion having a teardrop shape in plan and being placed on a flat sheet tray 2 duplicating the shape of the cake portion and attached thereto by an adhesive food substance. The area of each tray 2 is larger than that of the underside of one cake portion or pastry slice such that there is a gap between the adjacent cake portion or another pastry slice. The sliced cake is placed in a packaging obtained by molding food polymer material and comprises a base 4 and a transparent lid 5 that can be latched together. The cake portions are placed in the package at spacing from one another, and from the side and top walls of lid 5.

Figure 3:
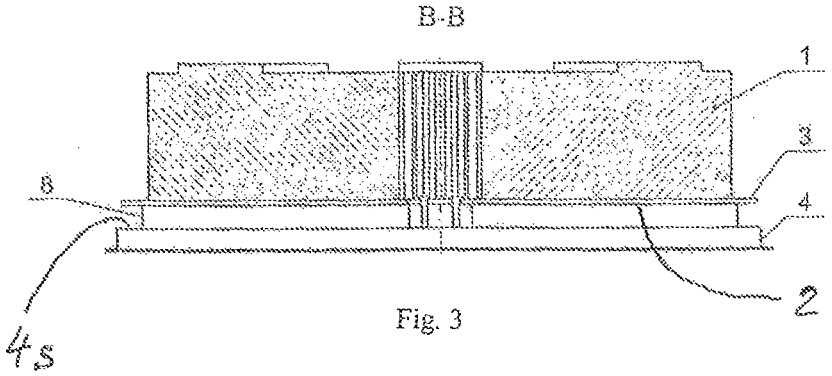
FIG. 3 is a sectional view along B-B of FIG. 2.
Figure 4:
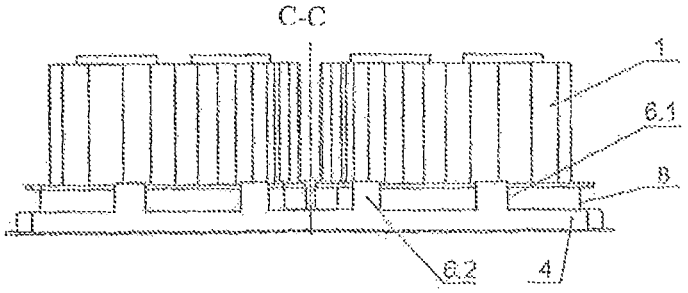
FIG. 4 is a sectional view along C-C of FIG. 2.
Figure 5:
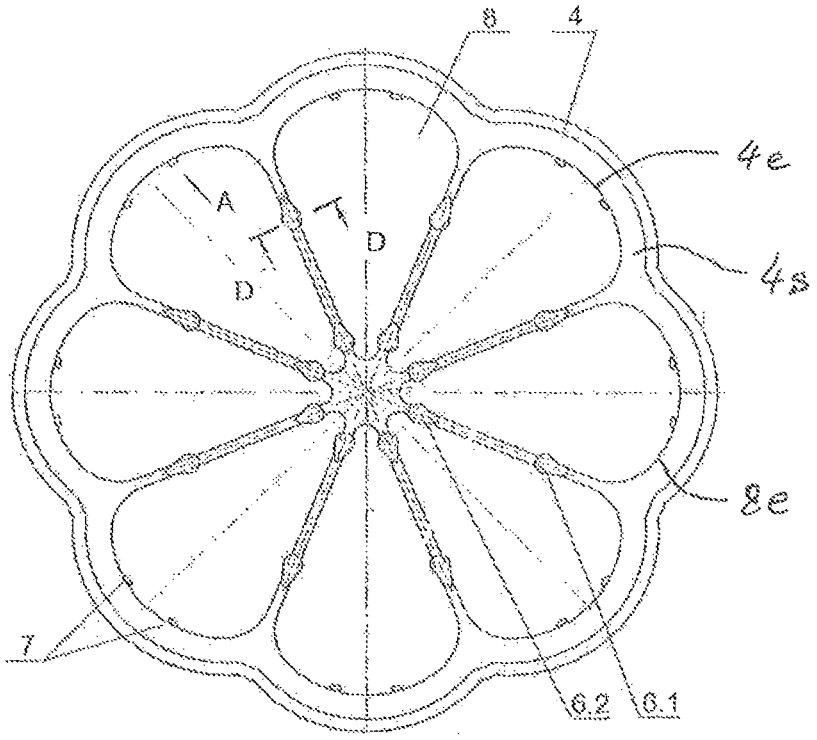
FIG. 5 is a top view of the packaging base.

The base 4 of the packaging is provided with raised flat sections 8 integrally (i.e., non-moveably) formed with the base 4 by molding so as to extend from a top surface 4*s* of the base 4, as illustrated in FIGS. 1, 3 and 5. As further illustrated in FIGS. 1-5, an outer peripheral edge 8*e* of each of the raised flat sections 8 is within an outer peripheral edge 4*e* of the base 4. The raised flat sections 8 are angularly (i.e., circumferentially) spaced and separated from each other by the top surface 4*s* of the base 4. The number of the raised flat sections 8 corresponds to the number of cake portions 1 (FIGS. 1, 4, and 5).

The raised flat sections 8 of the packaging base 4 serve for flat sheet trays 2 to be placed thereon, the trays 2 being made of laminated cardboard or food polymer material. One side of a tray facing the edge 4*e* of the base 4 is made integral with a mushroom-shaped tongue 3 (FIG. 2) extending beyond the plane of the raised flat section 8 (FIG. 3). As best shown in FIG. 2, an outer peripheral edge of the tongue 3 of each of the trays 2 does not extend beyond the base 4, i.e. is within the outer peripheral edge 4*e* of the base 4. This design makes for convenient removal of cake portion 1 together with its tray 2 from the packaging.

According to one embodiment of the invention, a tray may have two tongues.

Figure 6:
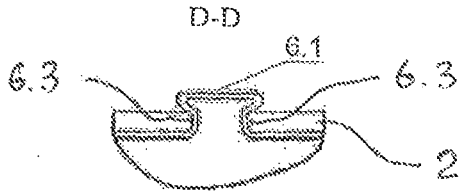
FIG. 6 is a sectional view along D-D of FIG. 5.

Two tray-anchoring projections are provided between each pair of trays integrally with the base, one of the projections, 6.1, being offset toward the packaging base and the other, 6.2, toward the central part of the base (FIGS. 4 and 5). Each of anchoring projections 6.1 and 6.2 has a teardrop shape in plan, the widened part thereof having a T-shaped cross-section (FIG. 6) and being rectangular lengthwise (FIG. 4). The height of each of these projections is greater than the total height of the raised section of the base and the thickness of the tray.

Figure 7:
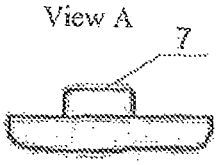
FIG. 7 is view A of FIG. 5.

A pair of low projections 7 (FIGS. 5 and 7) provided at the edge 8*e* of the raised section 8 facing the outer peripheral edge 4*e* of the base 4 (base periphery) serves to anchor a cake portion 1 together with the tray 2 having the tongue 3 on each raised section 8 in the radial direction. As shown in FIG. 7, each low projection 7 has a rectangular shape. The height of the low projections 7 is smaller than that of the projections 6.1 and 6.2.

Figure 8:
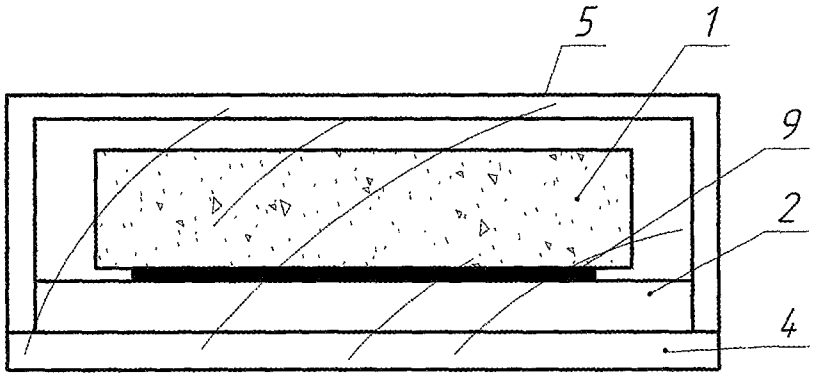
FIG. 8 is a side view of the packaging containing a confectionery product such as a piece of pastry.

The packaging is used as follows:

Food adhesive substance 9 (FIG. 8) is applied to the underside of each cake or pastry portion 1, or to tray 2 in an even layer, or as separate drops, whereupon the confectionery product is attached to tray 2. Next, trays 2 are anchored on raised section 8 of packaging base 4 by moving each tray with the confectionery product toward the center of the packaging base such that the widened T-shaped sections of anchoring projections 6.1 and 6.2 secure both adjacent trays reliably relative to raised sections 8 of the packaging base, and projections 7 on the sides of tongue 3 keep the tray with its tongue, with the portion of the confectionery product placed thereon, from moving.

The claimed design of the base and trays of the packaging allows a confectionery product to be secured reliably inside the packaging even if it is inclined at a large angle. For cake portion 1 to be removed from the packaging, it is enough to raise tray 2 slightly by pulling up tongue 2 to disengage it from projections 7 provided at the edge of section 8 of the packaging base and move the tray with the confectionery product out of slots 6.3 defined between the horizontal legs of the anchoring T-shaped projections 6.1 and 6.2 and the bottoms of the raised sections 8 of the base 4.

A portion of a confectionery product is secured in, and removed from, a packaging designed for one portion of a confectionery product (FIG. 8) similarly to the above, with the only difference that it is reasonable to use L-shaped anchoring projections at the sides of the raised section of the base.

The present invention secures confectionery goods reliably inside the packaging even at a large inclination angle during transportation to destination, and the packaging base and trays are designed to allow convenient removal of a confectionery product from the packaging.

The invention claimed is:

1. A packaging for portions of a confectionery product, comprising:

a base having at least one raised flat section integrally formed with the base and extending from a top surface of the base; and a plurality of trays each provided for supporting one of the portions of the product, each of the trays having an area larger than an area of an underside of one the portions of the product;

each of the trays disposed on the at least one raised flat section of the base and being removable from the at least one raised flat section of the base;

each of the trays having a removing part for removing the same from the base, the removing part being integral with the tray and projecting beyond the plane of the raised flat section of the base at the side facing an outer peripheral edge of the base; and at least one tray-anchoring projection formed on the base between each pair of adjacent trays;

an outer peripheral edge of the at least one raised flat section being within the outer peripheral edge of the base;

an outer peripheral edge of the removing part of each of the trays being within the outer peripheral edge of the base.

2. The packaging of claim 1, wherein the base thereof has several raised flat sections according to the number of the product portions, the raised flat sections are angularly spaced and separated from each other by the top surface of the base.

3. The packaging of claim 2, wherein each of the raised sections has a teardrop shape in plan that narrows toward a center of the base.

4. The packaging of claim 3, wherein two tray-anchoring projections are formed on the base between each pair of the adjacent trays, one of the projections being near the center of the base.

5. The packaging of claim 4, wherein each of the tray-anchoring projections has a widened part having a T-shaped cross-section and defining a slot between the widened part of each of the tray-anchoring protections and the raised flat section of the base for slidably receiving the tray therein.

6. The packaging of claim 1, wherein the removing part of the tray is in the form of a tongue.

7. The packaging of claim 6, wherein a pair of anchoring projections is provided at the edges of the raised section of the base for the tray tongue to be placed between them.

8. The packaging of claim 1, further comprising an anchoring projection formed in the center of the base.

9. The packaging of claim 1, wherein the base is made of food polymer material by molding.

10. A packaging for a portion of a confectionery product, comprising:

a base having a raised flat section integrally formed with the base and extending from a top surface of the base; and a tray provided for supporting the portion of the product, the tray having an area larger than an area of an underside of the portion of the product;

the tray disposed on the raised flat section of the base and being removable from the raised flat section of the base;

the tray having a removing part for removing the same from the base, the removing part being integral with the tray and projecting beyond the plane of the raised flat section of the base; and at least one tray-anchoring projection provided on the base on each side of the tray;

an outer peripheral edge of the raised flat section being within the outer peripheral edge of the base;

an outer peripheral edge of the removing part of the tray being within the outer peripheral edge of the base.

11. The packaging of claim 10, wherein two tray-anchoring projections are formed in the base on each side of the tray to anchor the same to the base.

12. The packaging of claim 11, wherein each of the tray-anchoring projections has a widened part having a T- or L-shaped cross-section and defining a slot slidably receiving the tray therein.

13. The packaging of claim 10, wherein the removing part of the tray is in the shape of a tongue.

14. The packaging of claim 13, wherein a pair of tray-anchoring projections is provided at an edge of the raised section of the base for the tray tongue to be received between them.

15. The packaging of claim 10, wherein the base and lid is made of a food polymer material by molding.

16. The packaging of claim 1, wherein the at least one tray-anchoring projection has a widened part having a T-shaped cross-section and defining a groove slidably receiving the tray therein.

17. The packaging of claim 1, further comprising a lid removably attached to the base.

18. The packaging of claim 10, further comprising a lid removably attached to the base.

* * * * *